United States Patent [19]

Lasson

[11] Patent Number: 5,002,195

[45] Date of Patent: Mar. 26, 1991

[54] DOUBLE CONTAINMENT TANK LINER SYSTEM

[75] Inventor: Alan R. Lasson, Salt Lake City, Utah

[73] Assignee: Baker Hughes Incorporated, Houston, Tex.

[21] Appl. No.: 492,686

[22] Filed: Mar. 13, 1990

[51] Int. Cl.[5] ..... G01M 3/00

[52] U.S. Cl. ..... 220/5 A; 220/469; 220/470

[58] Field of Search ..... 220/403, 460, 461, 464, 220/469, 5 A, 470

[56] References Cited

U.S. PATENT DOCUMENTS

| | | | |
|---|---|---|---|
| 4,000,595 | 1/1977 | Fortescue | 220/460 X |
| 4,552,166 | 11/1985 | Chadbourne, Sr. et al. | 220/461 X |
| 4,651,893 | 3/1987 | Mooney | 220/469 X |
| 4,739,895 | 4/1988 | Bachmann | 220/5 A |
| 4,840,283 | 6/1989 | Lillywhite et al. | 220/469 X |
| 4,859,262 | 8/1989 | Sharp | 220/469 X |
| 4,871,081 | 10/1989 | Ershig | 220/469 X |

*Primary Examiner*—Steven M. Pollard
*Attorney, Agent, or Firm*—Skjerven, Morrill, MacPherson, Franklin & Friel

[57] ABSTRACT

A plastic liner sheet is positioned between an outer bottom wall and an inner bottom wall of a dual wall tank providing uniform spacing and a degree of support. The liner sheet is molded with integral spacer elements in the form of semi-spherical bosses extending from the top and bottom surfaces of the liner sheet. Equilaterally positioned depressions surround each boss so that a boss on one side forms a depression on the opposite side and vice versa. The support function is augmented by providing a series of steel balls which are placed in selected depressions dependent on the expected loading on the tank bottom from the weight of the tank and its contents. The inner tank bottom may be constructed by butt welding a series of steel plates of desired shape to form the tank floor with weld backing plates resting on the liner top and supported by a linear line of the spaced steel balls in a spaced number of linearly aligned depressions.

20 Claims, 3 Drawing Sheets

DOUBLE CONTAINMENT TANK LINER SYSTEM

RELATED APPLICATION

This application relates to U.S. patent application Ser. No. 07/367,826 filed 06/19/89 entitled Double Shell Thickener and assigned to a common assignee. The disclosure of the related application is incorporated herein by reference.

BACKGROUND OF THE INVENTION

This invention pertains to a liner system for a double wall tank. More particularly the invention is directed to a liner system which extends between a spaced inner tank bottom and outer tank bottom of a tank and aids in providing leaking fluid egress from between the tank bottoms while supporting the inner tank bottom.

The above related application and its parent application now U.S. Pat. No. 4,840,283 is directed to a double containment tank particularly a liquid/solids clarifier or thickener tank where a normally conically sloped steel or concrete or plastic liner type outer bottom tank is provided with a sloped pervious layer of oiled sand confined in part by a series of support bars. An inner tank bottom in the form of welded steel sheets or other tank material is positioned on the oiled sand and bars. Any solids/liquid fluid leakage from the inner tank, either through the inner tank bottom or through the tank inner side walls, is transported through the sand to a desired location normally in or adjacent to the space between the inner and outer tank bottoms or between the walls of a double walled solids discharge cone in the inner bottom. A leak detector probe accesses leakage at that location, alerting operators to the presence of any leak occurring in the inner tank.

It has been found to be difficult, time consuming, labor intensive and expensive to form an inclined or inverse conical sand layer over a large surface area of an outer bottom. These areas may be as much as 6648 square meters. Further, the cost and weight of the support bars results in relatively high construction costs. Additionally, a tank supplier must rely on subcontractors to expeditiously supply sand and oil mixing facilities during installation. The oiled sand also acts to contaminate any leakage which might otherwise be recovered prior to repairing an identified leak. Further while oiled sand is fairly incompressible it can be caused to move by the loading within the tank not only packing the sand but actually causing it to move as earth moves under pressure. The spacing between the inner and outer bottoms can thus decrease, overall or locally, placing load strains on plate joints such as at the welds, to the detriment of the overall integrity of the inner tank. Thus a need has existed for a better dual containment tank support construction.

SUMMARY OF THE INVENTION

The present invention is directed to a dual containment tank utilizing a plastic liner sheet which is molded with a spaced series of integral spacer elements on a first obverse surface of the sheet which elements distally extend to contact a wall of a tank, normally the inner tank bottom wall, and a complementary second series of integral spacer elements on the reverse surface of the sheet in contact with an upper surface of an outer tank bottom wall. Fluid passageways and integral strengthening webs interconnect the integral spacer elements, which elements function to keep a uniform spacing between the tank bottoms. The spacer elements are in the form of spaced bosses formed in each side of the plastic sheet, the underside of a boss on one side of the sheet forming a depression on the other side of the sheet and vice versa. In order to augment the support function of the plastic sheet a number of high-strength shims or balls, preferably steel, of high incompressibility which resist loadings of the tank through the tank inner bottom are placed into selected ones of these depressions.

When the inner tank bottom is constructed of a series of abutting steel plates which are to be butt-welded together, a metal backing plate is preferably used under the butt weld joint, the backing plate resting on the upper tangential surface of a series of balls or bridging over two or more balls. Thus the butt joint areas are firmly supported by steel balls positioned in a predetermined number of liner depressions. In the event of the tank bottom being subjected to high heat which might actually melt the plastic sheet while under the tank load pressure, the steel balls will continue to space and support the inner wall or bottom with respect to the outer wall or bottom and the balls will be held in place by the compression present between the inner and outer walls or bottoms. A grid of steel balls typically on about 30 cm. centers may be utilized over the entire liner area each ball being in a top depression in the liner so that the inner tank bottom is supported by the overall liner and the balls.

The plastic liner may also contain small apertures at the boss apices or other locations so as to provide egress of any fluid leaking from the tank inner bottom to the underside of the liner. Leaks will pass through the passageways on the liner underside to a location at which a leak detector probe can detect the presence of the leaking fluid. Such detection is an indication of a malfunction and break in the inner tank integrity.

DETAILED DESCRIPTION

Figure 1:
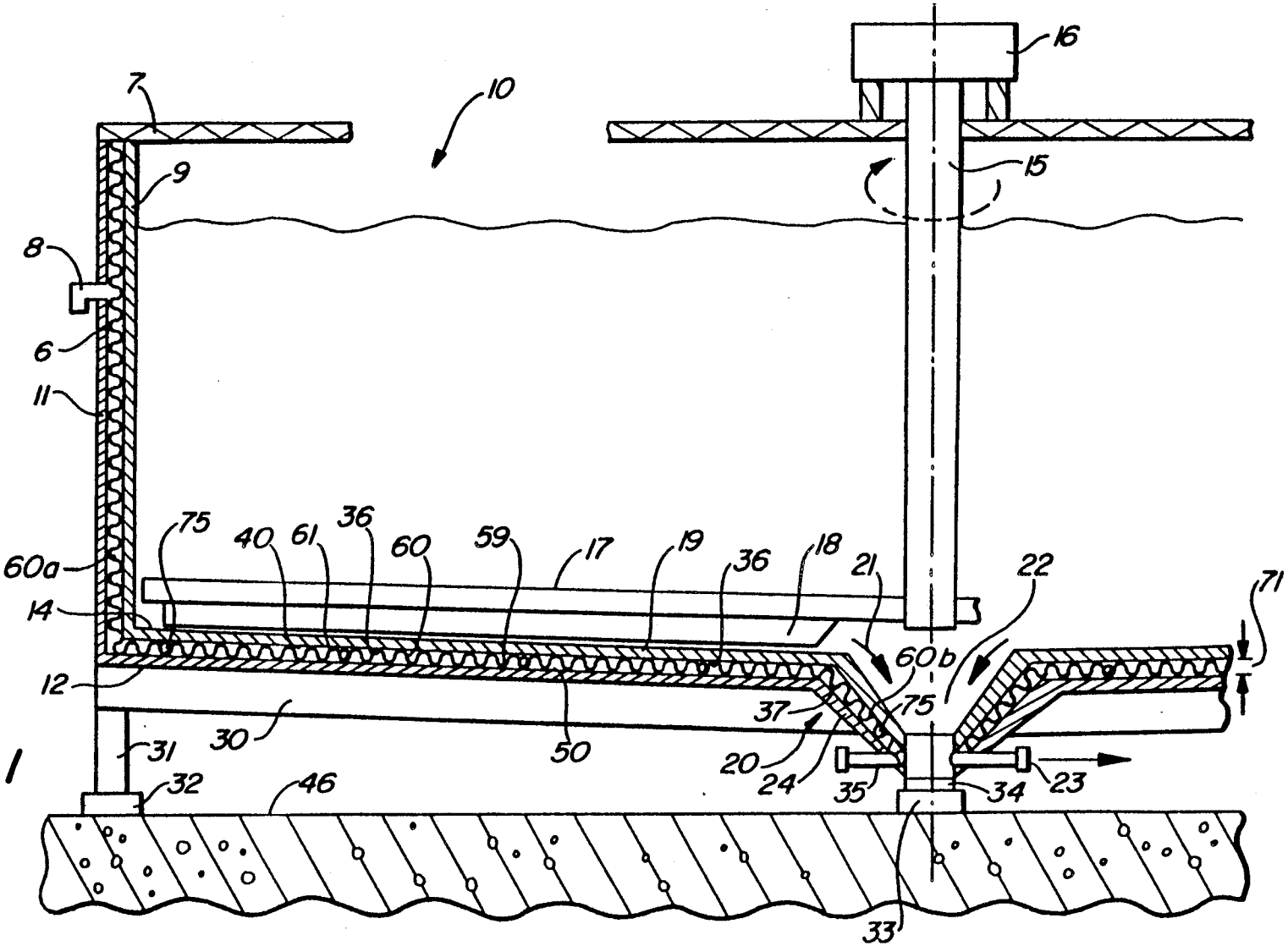
FIG. 1 is a schematic half, partial cross-section side view of a thickener incorporating the invention.

The invention hereof is described in terms of a thickener tank. As shown in FIG. 1 a double-wall bottomed thickener 10 comprises a circular vertical outer tank wall 11 surrounding and attached by welding or the like to the peripheral edges of an outer shell bottom 12 and an inner shell bottom 14 spaced therefrom by a plastic liner 60 in gap 71. The details of the liner, which basically is a formed plastic sheet having bosses 61 and depressions 59 over its upper and lower surfaces and spaced support steel balls 75 in selected depressions, are seen in FIGS. 3-6. The inner shell bottom has an inverse conical top surface 19 which receives settled solids or sludge from a solids-containing fluid contained ir the tank formed by wall 11 and inner shell bottom 14. Wall 11 may be a double-wall, the interior 6 of which between cuter wall 11 and inner wall 9 is in flow communication with the space between outer shell bottom 12 and inner shell bottom 14. Interior 6 may contain an extension 60*a* of liner 60.

As well known in the thickener art, typically a walkway truss 7 bridges across the tank and supports a rake drive mechanism 16. A central turbine shaft 15 extends into the tank from the drive mechanism and rotates one or more rake arms 17 affixed to the shaft end. Rake blades 18 extend downwardly along the rake arm. Blades 18 may include stainless steel or rubber squeegees on their bottom edges. Blade 18 and arm 17 rotate around the tank bottom surface 19 to transport settled solids radially inwardly into a central discharge cone 20. Solid line arrows 21 illustrate the movement of sludge from surface 19 to the interior 22 of the discharge cone. A sludge outlet 23 extends from the cone interior and is connected to a sludge pump (not shown) for removal of settled sludge from the thickener and the discharge cone. Not shown in FIG. 1 are conventionally employed peripheral tank launders, weirs, sampling ports, reaction walls, baffling and influent piping, for example.

In order to support the weight of the fluid in the thickener 10 in the preferred embodiment, an inert, non-compressible, load-carrying liner 60 fills the void space 36 between the shell bottoms 12, 14 in the gap 71 between the shell bottoms. The underside of bottom 14 presses onto the tops of the liner and on steel balls positioned in liner depressions.

Any leakage of fluid in the thickener tank either through the inner walls or the inner shell bottom 14 will drain onto the liner 60 and be conveyed by the passageways and apertures therein, typically along a slope rate of about 1:12 to about 2.5:12, to a position along the outer shell bottom into a downwardly sloping void space 37 between the double walls of the discharge cone, and then to a leak detection fluid outlet nozzle 35 through which a probe accesses the void spaces between the double side walls, the double-shell bottoms and the double discharge cone walls.

While the tank has been described in terms of a thickener tank, the tank may be used for clarification, flotation or as a simple storage tank for liquids or liquid - solids slurries.

Fabrication of the aforesaid structure is performed by providing suitable concrete pedestals 32, 33 on a concrete or other suitable ground support surface 46. Outer support legs 31, spaced around the tank periphery, support one end of a series of radial support beams 30 which are secured, as by welding, at their opposite ends onto the outer shell 24 of discharge cone 20. Discharge cone 20 may be supported by a center support leg 34 extending above pedestal 33.

Steel sheets are normally utilized for forming the outer tank bottom 12 and the inner tank bottom 14. The inner peripheral edges of the sheets are inserted under an angular annular flange (not shown) of inner cone shell 25. The steel sheets are then secured in place by butt welds preferably utilizing a backing plate 70 (FIG. 3) extending under the adjacent abutting steel sheets. The inner shell bottom is spaced above the outer shell bottom a distance of about 0.6–2.5 cm depending upon the diametric size of the tank and where along the radial surface of the tank bottom surface 19 the measurement is taken. In a typical about 7.6 meter ID tank having a 3 meter vertical wall, 0.6 cm thick steel sheets are utilized for the inner and outer shell bottoms.

The walls of the tank are also of double-wall construction and may have a liner section 60*a* therebetween for providing the void and a support between the liner and outer shell.

Figure 2:
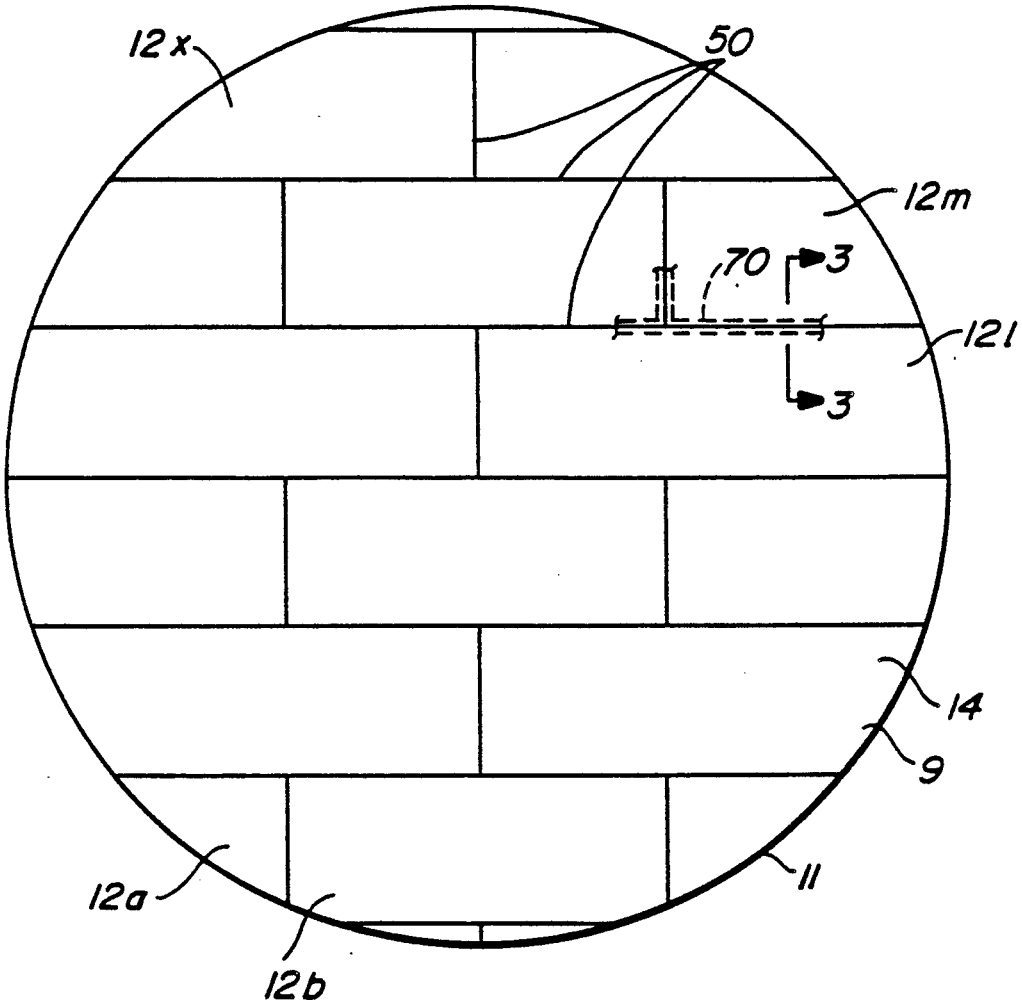
FIG. 2 is a top plan view of the thickener tank inner bottom.

FIG. 2 shows a typical layout of sheets 12*a*, 12*b*, . . . , 12× forming the inner shell bottom 14. Peripheral edges of the steel sheets abut adjacent sheets at linear loci 50 and are butt welded together so that the inner tank bottom 14 has nominal integrity at each of the weld joints.

Figure 3:
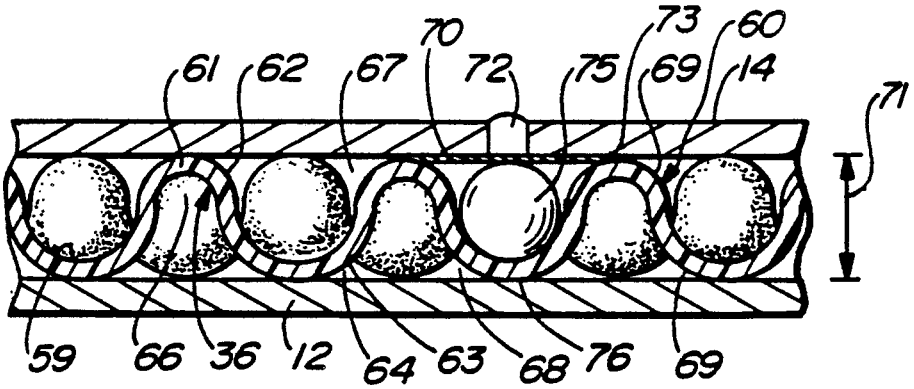
FIG. 3 is a cross-sectional view taken on the line 3—3 of FIG. 2 showing the support liner and a support ball of the invention.

As shown in FIG. 3 the tank bottom 14 is supported by a flexible thin liner 60 in the form of a thermally formed, somewhat flexible plastic sheet positioned on an bottom 12 in the space 36 between the inner bottom 14 and outer bottom 12. Outer tank bottom 12 may also be constructed of a series of steel plates butt welded to adjacent plates or may be constructed of concrete or other material.

Typically the outer bottom rests on piers as illustrated in FIG. 1, a concrete base or on a prepared ground base. It may be level or inclined. The liner 60 may also have a section 60*b* which extends between the walls of sump 20 so as to space and support the walls. The liner 60 is formed by a heat and vacuum process as is known in the prior art for the particular material being utilized. A first series of internal spacer elements 61 extend from a top surface 62 of the liner sheet 60 and a second series of integral spacer elements 64 extending from an opposed bottom surface 63 of the plastic sheet. The spacer elements are in the form of semi-spherical bosses 61 and semi-spherical depressions 59 equilaterally surrounding each boss. A boss 61 on the first surface forms a depression 66 on the second surface such that every boss on one side is a complement of a depression on the other side and a boss or peak 64 on the bottom side of the liner has a complementary depression (valley) 59 on the top side of the liner. Interconnect passageways 67 and 68 are provided on the top side of the sheet and the bottom side of the sheet, respectively.

Each of the bosses have an additional support means in the form of a connecting web 69 extending between and connected to the proximal (base) end of each of the bosses of each hill and valley grid forming the series of spacer elements. The connecting webs comprise saddle-like portions extending equilaterally at 90° spacings from each of the semi-spherical bosses. A further support in the form of a series of essentially incompressible supporting spheres such as balls 75 or other shims of cylindrical or other shape are placed in selected depressions, normally on the top liner surface to augment the support afforded by the liner 60 itself.

The balls 75 which typically are a 1.6 cm (⅝ inch) steel ball may be of a diameter matching the gap 71 between the bottoms 12 and 14 and the total height of the liner 60. The balls may be stainless steel or any other material compatible with the needs of metallic or non-metallic installations. The balls may be of a smaller diameter or height e.g. about 1.3 cm, so that a 0.3 cm thick weld backing plate 70 (shown partially by dash lines in FIG. 2) may be placed over a linear series of balls at their top tangential surface. The backing plates and the butt joint 72 formed thereover, between abutting steel section plates forming the inner bottom 14, are then particularly well supported. The backing plates may be placed in a cut-out 73 between adjacent bosses so that the backing plate rests on the steel ball. In a preferred embodiment the balls have an interference fit with the depression in which they rest. A slight flex of the liner on opposite sides of the depression easily releases a ball.

The liner maintains a uniform spacing i.e. gap 71 between the inner bottom 14 and outer bottom 12 even where heat or pressure would tend to cause reduction in the uniform spacing due to the inherent flexibility of the liner. The liner is preferably formed of polyvinylchloride, high density polyethylene or other ABS plastic having a thickness of from about 1.5 mm to about 2.0 mm resulting in a relatively stiff support sheet. In the event that there is an excess of heat transferred from the tank by the temperature of its contents or by a outside event such as fire, the steel ball would pass down through the liner thickness melting the liner and still be held in place tangent to the weld plate and tank outer bottom at 76 and supporting the inner bottom and its tank contents, due to pressure of the inner tank weight on the inner tank bottom against the balls and the outer tank bottom. The particular placement of the balls is dependent on expected loads based on tank contents, inequalities in the tank bottom, steel plate irregularities and features of the desired welded joints.

Figure 4:
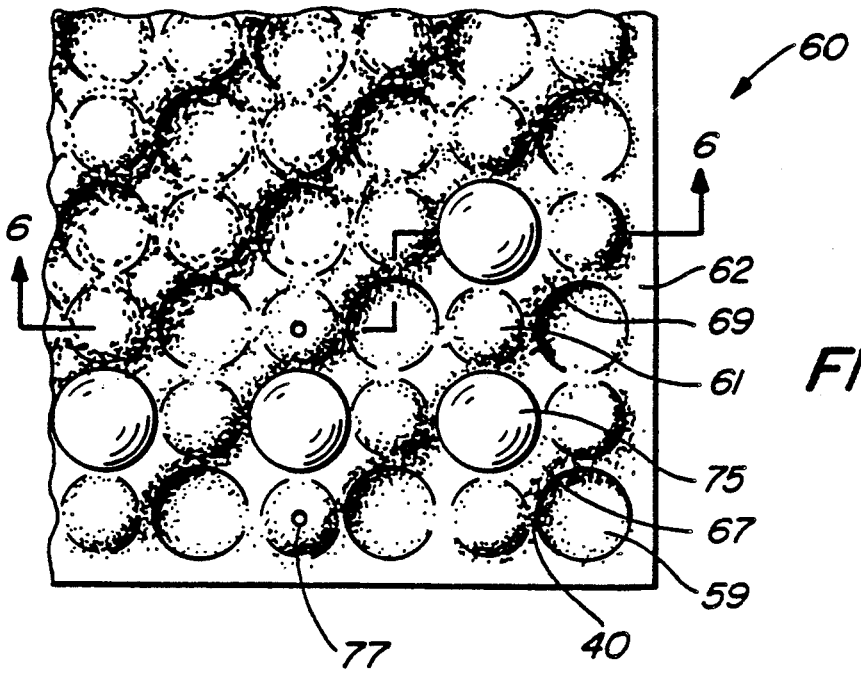
FIG. 4 is a top plan view of the liner per se showing several support balls in liner depressions.

FIG. 4 illustrates in more detail the top surface of liner showing the rows and ranks of the semi-spherical bosses 61 and the depressions 59, the interconnect passageways 40, the connecting webs 69 and a pair of steel balls 75 in four of the depressions.

Figure 5:
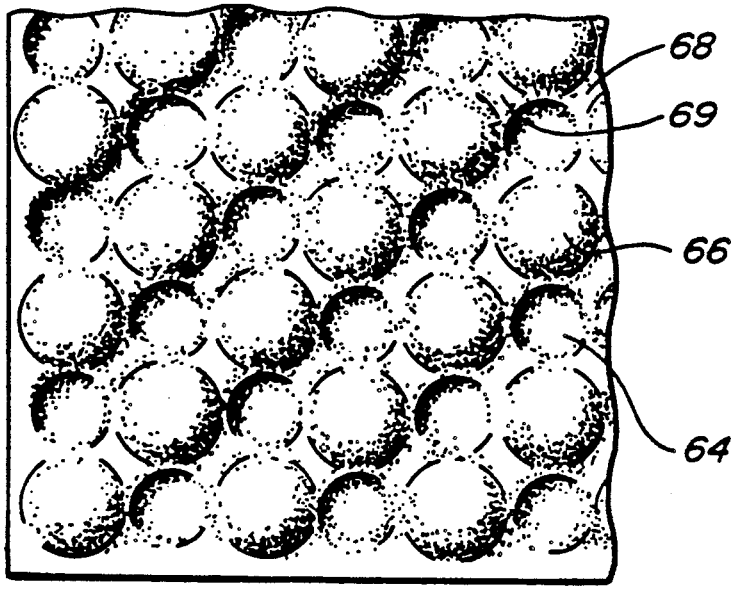
FIG. 5 is a bottom view of the liner per se showing bottom bosses complimentary to top side depressions.

FIG. 5 illustrates the bottom surface of the liner where the top surface depressions 59 form the complementary bottom surfaces bosses 64. Saddle-like web portions 69 are also visible. The bosses 64 on the underside of sheet may have the same or be a greater diameter than the bosses 61 on the top surface of the sheet.

Figure 6:
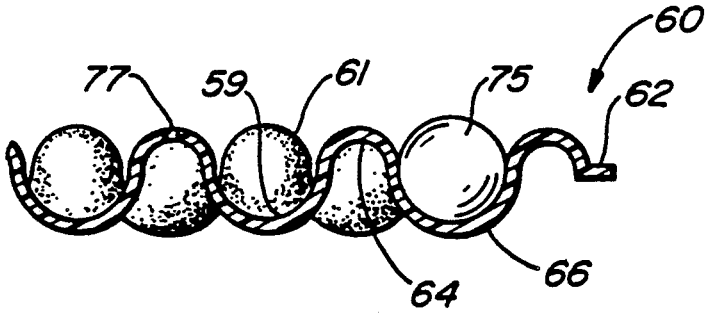
FIG. 6 is a cross-sectional view of the liner taken on the line 6—6 of FIG. 4.

As seen in FIG. 6 the plane 62 of the original unformed sheet is offset from the medial plane between the apices of the top and bottom bosses. This results in simplicity of design, manufacturing process and maximizing structural strength by maintaining a minimum of parent material wall thickness reduction. The bosses, particularly the top bosses, may be apertured by one or more 1–2 mm punched holes 77, allowing any tank-contained fluid leaking through a developed leak path in inner bottom 14, to egress to a passageway 68 above outer bottom 12 from where the leak can be transported to a location 37 at which location the leak can be detected by a leak detection probe (not shown) extending into pipe 35. In a typical installation, the liner is in the form of imperforate formed sheets about 122 cm by 144 cm in size abutted to similar sheets and cut to extend over the entire bottom of the outer tank bottom. The depressions 59 form a grid of small caps which will become filled with leaked fluid from the inner tank before the leak fluid spills into the outer containment surface 12 at the sheet outer edges.

The double containment tank illustrated in FIGS. 1–6 is constructed by performing the following steps in seriatim: forming a tank outer bottom; erecting a tank cylindrical wall; placing a tank liner over the outer bottom with the liner bottom bosses in contact with a top surface of the tank outer bottom and the top bosses extending upwardly from a top surface of said liner; inserting a predetermined number of support balls in selected ones of the depressions between the top bosses; placing a series of weld backing plates over linear portions of the liner and in contact with a desired number of balls; aligning abutting edges of a series of metal plates over the backing plates; and welding the metal plates abutting edges along the backing plates to form a nominally imperforate tank inner bottom. The support balls function to support a fluid-containment load confined by the tank inner bottom and said cylindrical wall and with the liner maintains a uniform spacing between the tank outer bottom and the tank inner bottom.

The above description of the preferred embodiment of this invention is intended to be illustrative and not limiting. Other embodiments of this invention will be obvious to those skilled in the art in view of the above disclosure.

I claim:

1. A container tank liner comprising:

a formed support sheet;

a spaced first series of integral spacer elements extending from a first surface of said sheet;

a spaced second series of integral spacer elements extending from a second surface of said sheet, said first and second surfaces being on opposed sides of said sheet;

wherein interconnect passageways on each of said surfaces extend between said first series of spacer elements and said second series of spacer elements; and support means in selected positions along and in contact with at least one of said passageways for augmenting the support function of said sheet.

2. The tank liner of claim 1 in which said formed support sheet is a thermally formed plastic sheet.

3. The tank liner of claim 2 in which said plastic sheet is a thickness of from about 1.6 mm to about 2.0 mm.

4. The tank liner of claim 3 in which said first series of spacer elements comprise a first grid of bosses distally extending from said first liner surface.

5. The tank liner of claim 4 wherein said second grid of bosses are equilaterally formed between the bosses of said first grid of bosses.

6. The tank liner of claim 4 in which said second series of spacer elements comprise a second grid of bosses distally extending from said second liner surface.

7. The tank liner of claim 6 wherein said support means comprises a connecting web extending between and connected to a proximal end of each of the bosses of each of said grids.

8. The tank liner of claim 6 in which said support means further comprises a supporting sphere positioned in an underside of a boss in said second grid and between a series of bosses of said first grid.

9. The tank liner of claim 8 in which said supporting sphere is a steel metal ball.

10. The tank liner of claim 9 wherein said boss underside is dimensioned such that said ball is in an interference fit with said boss underside to hold said ball fixedly therein.

11. The tank liner of claim 10 wherein said sheet has a sufficient flex such that said boss underside can be flexed laterally to release a held one of said balls from its interference fit.

12. The tank liner of claim 1 wherein said support sheet includes a series of leak apertures therein such that any leak of fluid contained by one of said walls passes through one of said surfaces of said sheet to interconnect with said passageways on one opposed surface of said sheet for detection of said leak.

13. A double wall tank construction including a first wall and a second wall parallel to and spaced from the first wall; and a tank liner formed between said walls and having distal surfaces in contact with facing surfaces of said walls, said tank liner comprising:

a formed support sheet;

each of said distal surfaces including a series of integral spacer elements extending in rows and ranks on said sheet and wherein the rows and ranks of said elements on one distal surface are offset from the rows and ranks of said elements on an opposed distal surface, and support means extending between selected ones of said elements for supporting said sheet under a load exerted by one of said walls against said sheet.

14. The tank construction of claim 13 in which said first wall is an imperforate tank outer bottom and said second wall is a nominally imperforate tank inner bottom comprising a series of butt welded metal sheets and wherein a backing plate extends under the butt welds and over said tank liner, and wherein said support means includes a series of high strength balls extending under said backing plate.

15. The tank construction of claim 14 in which said spacer elements comprise a series of integral peaks and valleys extending across said support sheet and wherein said balls are positioned in a sheet valley facing said backing plate.

16. The tank construction of claim 14 wherein said balls have a diameter such that a ball top tangential surface extends at least to a plane formed by the distal ends of said elements facing said backing plate.

17. The tank construction of claim 13 wherein said support sheet is a thermally formed relatively stiff plastic sheet, said elements comprising a series of semi-spherical bosses and semi-spherical depressions on each of said distal surfaces, the depressions on one distal surface forming the bosses on the other distal surface, and wherein said support means comprises a series of steel balls positioned in a series of said depressions for augmenting the load-carrying capabilities of said support sheet.

18. The tank construction of claim 17 in which passageways are formed between groups of bosses and groups of depressions and including aperture means in said support means permitting any leaks of fluid through one of said walls to enter a passageway in flow communication with the other wall, and including means for detecting any fluid leakage in said passageway.

19. A double containment tank construction method comprising:

forming a tank outer bottom;

erecting a tank cylindrical wall;

placing a tank liner over said outer bottom; said tank liner having a first series of bottom spaced bosses in contact with a top surface of said tank outer bottom and a second series of spaced bosses extending upwardly from a top surface of said liner and having depressions therebetween formed by the spaced bosses of said first series of bottom spaced bosses;

inserting a predetermined number of support balls in selected ones of said depressions;

placing a series of weld backing plates over said liner and in contact with said balls;

aligning abutting edges of a series of metal plates over said backing plates, said metal plates forming a tank inner bottom; and welding said metal plates abutting edges along said backing plates to form a nominally imperforate tank inner bottom, and wherein said support balls function to support a fluid-containment load confined by said tank inner bottom and said cylindrical wall and said liner maintains a uniform spacing between said tank outer bottom and said tank inner bottom.

20. A double containment tank construction method comprising:

forming a tank outer bottom;

placing a tank liner over said bottom, said tank liner having a first series of bottom spaced bosses in contact with a top surface of said tank outer bottom and a second series of top spaced bosses extending from a top surface of said tank liner, said second series of bosses having depressions therebetween formed by said first series of bottom spaced bosses;

inserting a predetermined number of discrete high-strength shims in selected ones of said depressions; and placing a tank inner bottom over said tank liner in contact with a top surface of said shims and a distal end of said bosses, wherein said shims support said tank inner bottom and said liner maintains a uniform spacing between said tank outer bottom and said tank inner bottom.

* * * * *